US011480923B2

(12) United States Patent
Heraud et al.

(10) Patent No.: US 11,480,923 B2
(45) Date of Patent: Oct. 25, 2022

(54) ESCAPEMENT FOR A TIMEPIECE WITH OPTIMIZED TORQUE TRANSMISSION

(71) Applicant: RICHEMONT INTERNATIONAL SA, Villars-sur-Glâne (CH)

(72) Inventors: Alexis Heraud, Pontarlier (FR); Valentin Molina, Pontarlier (FR)

(73) Assignee: RICHEMONT INTERNATIONAL SA, Villars-sur Glâne (CH)

( * ) Notice: Subject to any disclaimer, the term of this patent is extended or adjusted under 35 U.S.C. 154(b) by 791 days.

(21) Appl. No.: 16/349,905

(22) PCT Filed: Nov. 16, 2017

(86) PCT No.: PCT/EP2017/079518
§ 371 (c)(1),
(2) Date: May 14, 2019

(87) PCT Pub. No.: WO2018/091616
PCT Pub. Date: May 24, 2018

(65) Prior Publication Data

US 2020/0064776 A1 Feb. 27, 2020

(30) Foreign Application Priority Data

Nov. 17, 2016 (CH) ..... 01521/16

(51) Int. Cl.
*G04B 15/14* (2006.01)
*G04B 15/08* (2006.01)

(52) U.S. Cl.
CPC ..... *G04B 15/14* (2013.01); *G04B 15/08* (2013.01)

(58) Field of Classification Search
CPC ..... G04B 15/14; G04B 15/08
(Continued)

(56) References Cited

U.S. PATENT DOCUMENTS 3,628,327 A 12/1971 Abe

FOREIGN PATENT DOCUMENTS

CH 702689 8/2011
CH 702689 B1 * 8/2011 ..... G04B 15/08
(Continued)

*Primary Examiner* — Edwin A. Leon
*Assistant Examiner* — Kevin Andrew Johnston
(74) *Attorney, Agent, or Firm* — Duane Morris LLP; Gregory M. Lefkowitz; Brandon A. Chan

(57) ABSTRACT

An escapement for a timepiece, comprising: —an escapement wheel pivotally mounted around a corresponding axis of rotation and intended to be driven by a drive source, said escapement wheel comprising a plurality of teeth; —a pallet fork pivotably mounted around a corresponding axis of rotation, said pallet fork comprising an entry pallet and an exit pallet, each pallet comprising a rest face arranged to block the escapement wheel, as well as a pulse face arranged to interact with the escapement wheel in order to transmit the pulses received from the latter to a regulating member arranged to perform oscillations, said pallet fork being arranged to free the escapement wheel periodically under the control of the regulating member, characterized in that at least one of the pulse faces is shaped in such a way that, on at least one portion of the pulse face, and considered at each point of contact (C') between the escapement wheel and the pulse face, the tangent of the pulse face intersects the center-to-center distance between the escapement wheel and the pallet fork according to an angle (αorientation) that observes a particular relation.

14 Claims, 10 Drawing Sheets

(58) Field of Classification Search
USPC ..... 368/124
See application file for complete search history.

(56) References Cited

FOREIGN PATENT DOCUMENTS

| | | | | |
|---|---|---|---|---|
| EP | 2336832 A2 * | 6/2011 | ..... | G04B 15/08 |
| EP | 2431823 | 3/2012 | | |

* cited by examiner

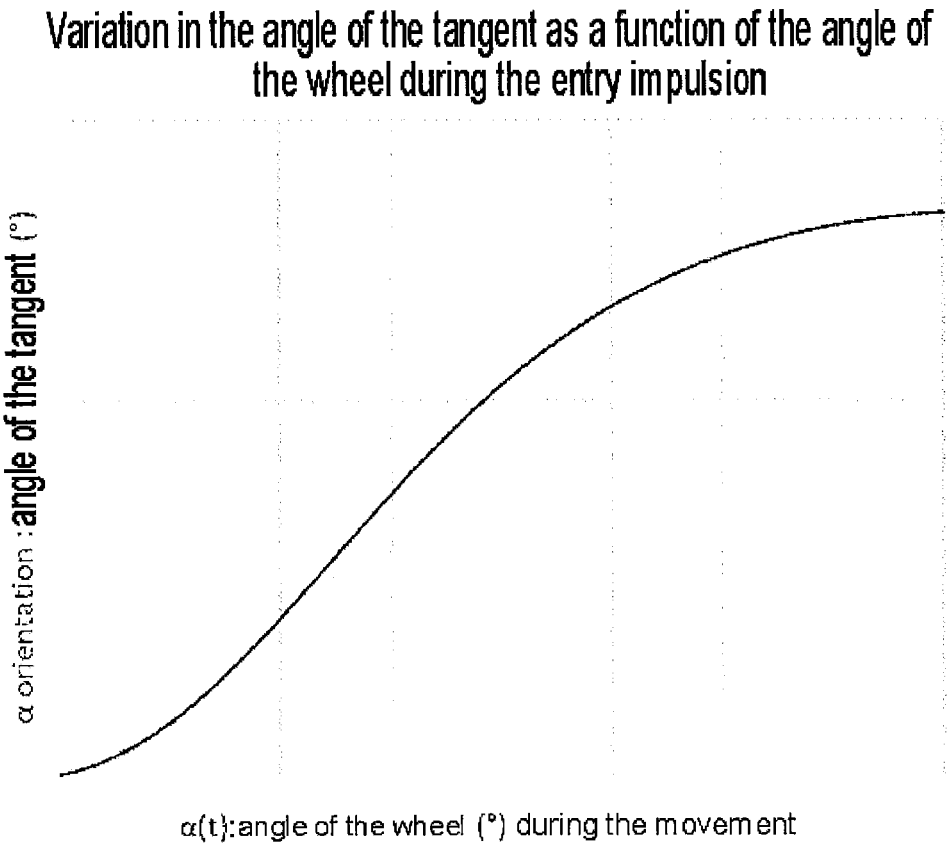
Figure 7
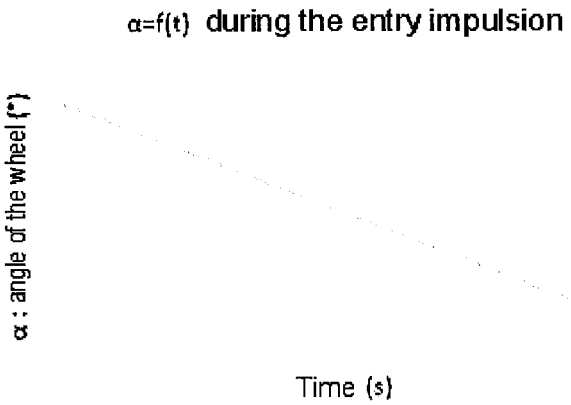

Variation in the angle of the tangent as a function of the angle of the wheel during the exit impulsion
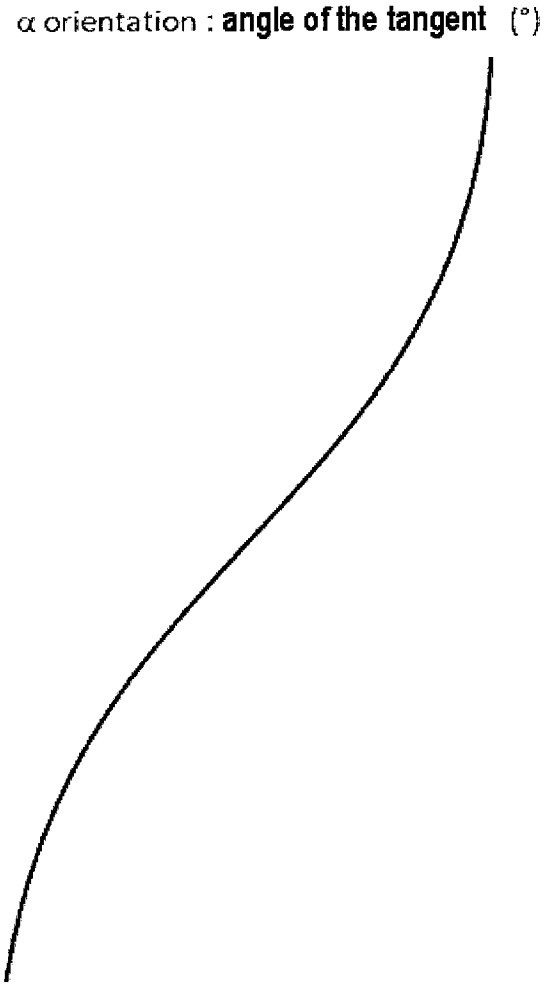
α(t) : angle of the wheel (°) during the movement
Figure 8
α=f(t) during the exit impulsion
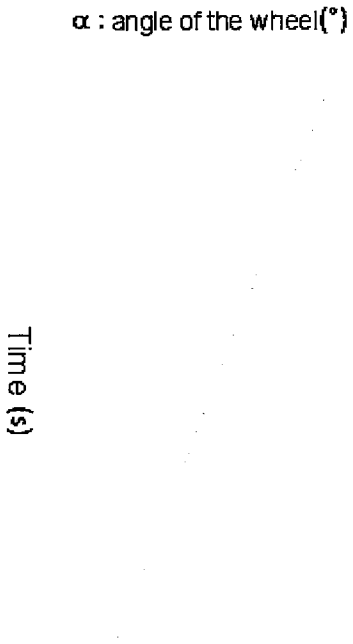
Time (s)

ESCAPEMENT FOR A TIMEPIECE WITH OPTIMIZED TORQUE TRANSMISSION

CROSS-REFERENCE TO RELATED APPLICATIONS

This application is a § 371 national stage entry of International Application No. PCT/EP2017/079518, filed Nov. 16, 2017, which claims priority of Swiss National Application No. 01521/16, filed Nov. 17, 2016, the entire contents of which are incorporated herein by reference.

TECHNICAL FIELD

The present invention relates to the field of watchmaking. It concerns, more particularly, an escapement with optimized torque transmission.

BACKGROUND ART

A traditional escapement, such as a Swiss anchor escapement, an English anchor escapement, a Daniels escapement or similar, includes an anchor which blocks an escapement wheel in an intermittent manner and transmits energy from the going train to the regulating member when the wheel is released. Oscillations of the regulating member, such as a balance wheel and hairspring, actuate the anchor lever in order to perform this periodic release of the escapement wheel and to supply an impulsion once more to the regulating member in order to maintain its oscillations.

To this end, the anchor includes at least two pallets, one of which—the entry pallet—being situated upstream in relation to the direction of rotation of the escapement wheel, and the other—the exit pallet—being situated downstream. On each half-oscillation of the regulating member, the pallet which is engaged with the escapement wheel is raised, releasing the escapement wheel and transmitting an impulsion to the regulating member by means of an impulsion surface that each pallet includes. At the same time, the other pallet is displaced in the trajectory of the teeth of the escapement wheel and blocks it. Then, the cycle recommences for the other pallet.

Typically, the impulsion surfaces are constituted by planes. Although these simple forms are easy to manufacture, the transmission of torque varies throughout the impulsion phase, which is detrimental to the performance of the escapement.

Furthermore, such plane impulsion surfaces often give rise to a lifting-off of the pallet, in particular when it performs the transition from the impulsion phase on the pallet to the impulsion phase on the tooth, which similarly compromises the performance of the escapement.

Document CH702689 describes an escapement in which the exit pallet and/or the entry pallet presents an impulsion surface which is curved in such a way that, during an entire part of the impulsion phase, the angle defined by the impulsion surfaces of the tooth and of the pallet at the point of contact between these surfaces is at most equal to 7°. Although this certainly represents an improvement in relation to planar impulsion surfaces, the form chosen does not eliminate the variations in the transmission of torque. A modeling study has shown that the derivative of the torque ratio between that of the anchor and that of the escapement wheel in relation to the angle of the escapement wheel changes sign several times, and that said torque ratio varies in the order of 25% to 35% along the concave part of the pallet. In addition, the convex part at the start of the impulsion surface exhibits an entirely conventional radius of curvature, which results from the current manufacturing processes, and has not been optimized at all.

The object of the present invention is thus, at least partially, to overcome the disadvantages mentioned above.

DISCLOSURE OF THE INVENTION

To this end, the invention relates to an escapement for a timepiece. This escapement comprises an escapement wheel mounted in a pivotable manner about an axis of rotation and intended to be driven by a power source, said escapement wheel including a plurality of teeth.

The escapement comprises in addition an anchor mounted in a pivotable manner about an axis of rotation, and comprises an entry pallet as well as an exit pallet. Each pallet comprises a rest surface arranged to block said escapement wheel during the rest phases, as well as an impulsion surface arranged to interact with said escapement wheel in order to transmit impulsions received from the latter to a regulating member arranged to carry out oscillations, said anchor being arranged to release said escapement wheel periodically under the control of said regulating member.

According to the invention, at least one, and preferably each, of said impulsion surfaces is configured in such a way that, on at least one part of said impulsion surface, and considered at each point of contact between the escapement wheel and said impulsion surface, the tangent of said impulsion surface intersects the center-to-center line between the escapement wheel and the anchor at an angle which observes the relationship $$\alpha_{orientation} = \alpha - COF + \tan^{-1}\left(\frac{C * R + \cos(\alpha - \theta) * R_2}{R_2 * \sin(\alpha - \theta)}\right) +/-10\%$$

where $$R_2 = \sqrt{R^2 * \sin^2(\alpha) + (-R * \cos(\alpha) + L)^2}$$

and where $$\theta = \tan^{-1}\left(R * \frac{\sin(\alpha)}{L - R * \cos(\alpha)}\right).$$

In these equations, all the angles are expressed in radians, and

- $\alpha_{orientation}$ is the angle between said tangent and said center-to-center line;
- $\alpha$ is the angle between a line joining said point of contact and the axis of rotation of said escapement wheel and said center-to-center line;
- COF is the trigonometric tangent of the coefficient of friction between the escapement wheel and said impulsion surface (that is to say tan ($\mu$) according to the usual notation);
- R is the distance between the axis of rotation of said escapement wheel and said point of contact, +/−10%;
- C is the torque ratio between that of the anchor and that of the escapement wheel (that is to say $C_{anchor}/C_{wheel}$); and
- L is the length of said center-to-center line.

In so doing, the transmission of torque between the escapement wheel and the anchor is improved, since it remains constant throughout the impulsion phase. This constant transmission maximizes the transmitted torque, improves the performance of the escapement and minimizes the disturbance of the regulating member. It should be noted that a study has shown that the form of the pallet in document CH702689 does not correspond to the form defined above, and that the transmission of torque is not substantially constant, as noted in the preamble. This is due primarily (although not exclusively) to the fact that the angle defined by the impulsion surfaces of the tooth and of the pallet at the point of contact between these surfaces is constant and is at most equal to 7° (preferably at most equal to 5°), which can never be consistent with the above-mentioned equations.

If these equations are applied to an escapement of conventional geometry, the impulsion surface of the entry pallet is thus convex, and that of the exit pallet is concave, on the part of each surface for which the relationships are valid.

Advantageously, the form of at least one part of each of said impulsion surfaces observes said relationship, with the effect that the transmission of torque is constant for each pallet.

Advantageously, the escapement wheel includes teeth having convex impulsion surfaces. The transition between the various phases is thus smooth, which prevents the pallet from lifting-off from the wheel during the cycle.

With the same aim, the invention likewise concerns an escapement which comprises an escapement wheel mounted in a pivotable manner about an axis of rotation and intended to be driven by a power source, said escapement wheel including a plurality of teeth. The escapement comprises in addition an anchor mounted in a pivotable manner about an axis of rotation, and comprises an entry pallet as well as an exit pallet. Each pallet comprises a rest surface arranged to block said escapement wheel as well as an impulsion surface arranged to interact with said escapement wheel in order to transmit the impulsions received from the latter to a regulating member arranged to produce oscillations, said anchor being arranged to release said escapement wheel periodically under the control of said regulating member.

According to the invention, on at least one part of an impulsion surface that each of said teeth includes, and considered at each point of contact between said impulsion surface and one of said pallets (in particular the downstream beak of one of the latter), the tangent of said impulsion surface intersects the center-to-center line between the escapement wheel and the anchor at an angle which observes the relationship $$\alpha_{orientation} = \tan^{-1}\left(\frac{R * Seuil * \alpha * \cos(\alpha) + C * R * \cos(\alpha) + R * \cos(\alpha) - L}{R * \sin(\alpha) * (Seuil * \alpha + C - 1)}\right)_{+/-10\%}$$

In this equation, $\alpha_{orientation}$ is the angle between said tangent and said center-to-center line;

$\alpha$ is the angle between a line joining said point of contact and the axis of rotation of said escapement wheel and said center-to-center line;

Seuil is a value of a lifting-off threshold between the escapement wheel and the anchor selected, for example, by experimentation or by modeling;

R is the distance between the axis of rotation of said escapement wheel and said point of contact, +/−10%;

C is the torque ratio between that of the anchor and that of the escapement wheel;

L is the length of said center-to-center line.

In so doing, a lifting-off of the pallet with respect to the tooth may be eliminated when the pallet performs the transition from the phase known as "impulsion on the pallet" to the phase "impulsion on the tooth", since the strong acceleration that is produced with typical forms of teeth is significantly reduced. Since the pallet remains constantly in contact with the tooth and does not lift off, the transmission of torque from the escapement wheel to the anchor, and accordingly the performance of the escapement, are improved. Even if document CH702689 states generically that the teeth of the escapement wheel may be slightly curved, this does not correspond to the specific form defined above. Furthermore, and as noted in the preamble, the combination of the form of the teeth as well as that of the pallets is particularly susceptible to lifting-off during the transition of the tooth between the rest surface and the impulsion surface, and can therefore never be consistent with the above-mentioned equation.

If this equation is applied to an escapement exhibiting a conventional geometry, the impulsion surfaces of the teeth of the escapement wheel will be convex.

Advantageously, said value Seuil is a function of the first derivative of the speed ratio of the anchor on the escapement wheel during the impulsion on the beak of said pallet. As an alternative, this value may be defined arbitrarily.

Advantageously, the escapement according to the invention comprises each of the above-mentioned optimizations, that is to say that relating to the impulsion surfaces of the pallets, as well as that relating to the impulsion surface of the teeth of the escapement wheel.

The invention also relates to a watch movement comprising an escapement as defined above, and also to a timepiece comprising such a movement.

BRIEF DESCRIPTION OF THE DRAWINGS

The invention will be more readily appreciated by reading the following description of an embodiment, given by way of example and made with reference to the drawings, in which:

FIG. 7 represents a graph of the development of the tangent of the profile of the impulsion surface of the entry pallet during the impulsion phase, in terms of the angle and in terms of time;

FIG. 8 represents a graph of the development of the tangent of the profile of the impulsion surface of the exit pallet during the impulsion phase, in terms of the angle and in terms of time;

EMBODIMENTS OF THE INVENTION

Figure 1:
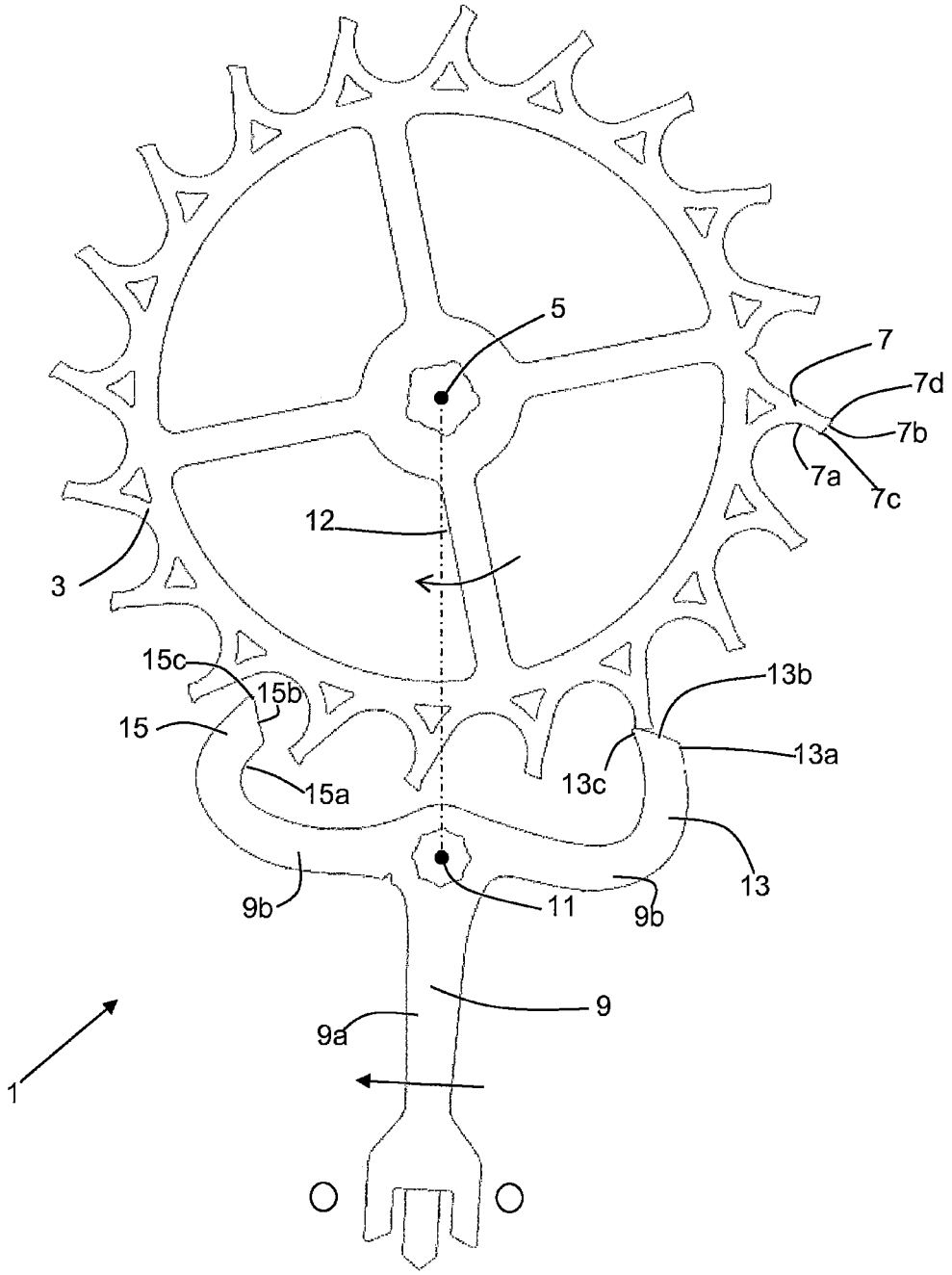
FIG. 1 represents a schematic plan view of an escapement according to the invention.
Figure 2:
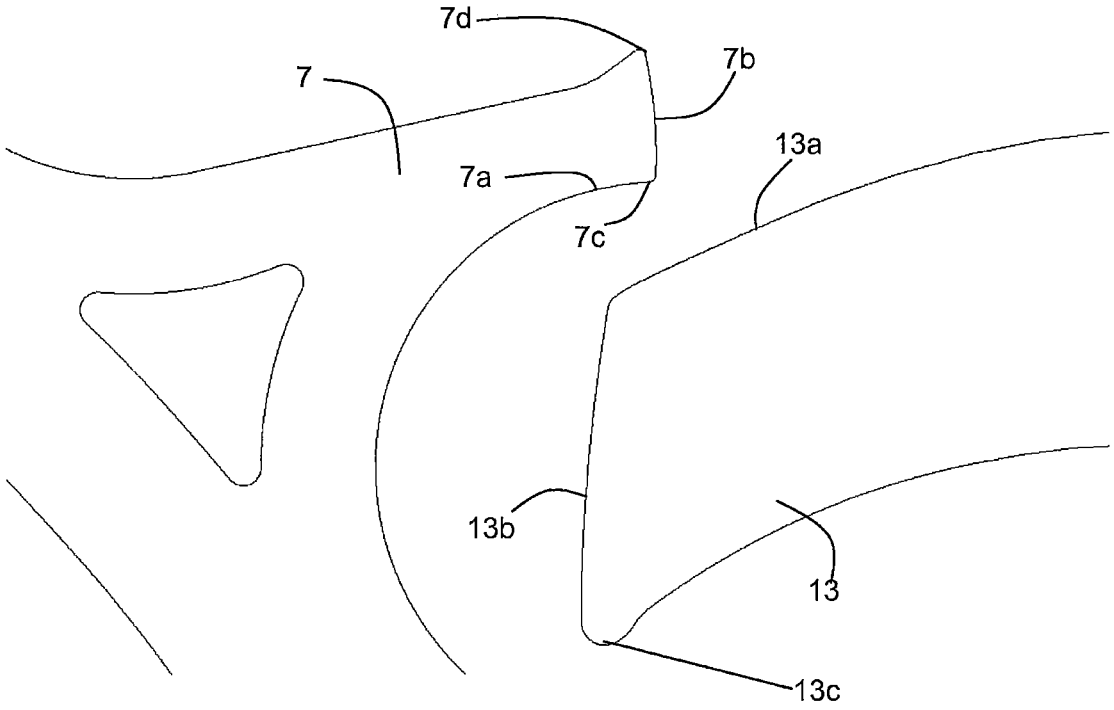
FIG. 2 represents an enlarged view of a tooth of the escapement wheel and of the entry pallet.
Figure 3:
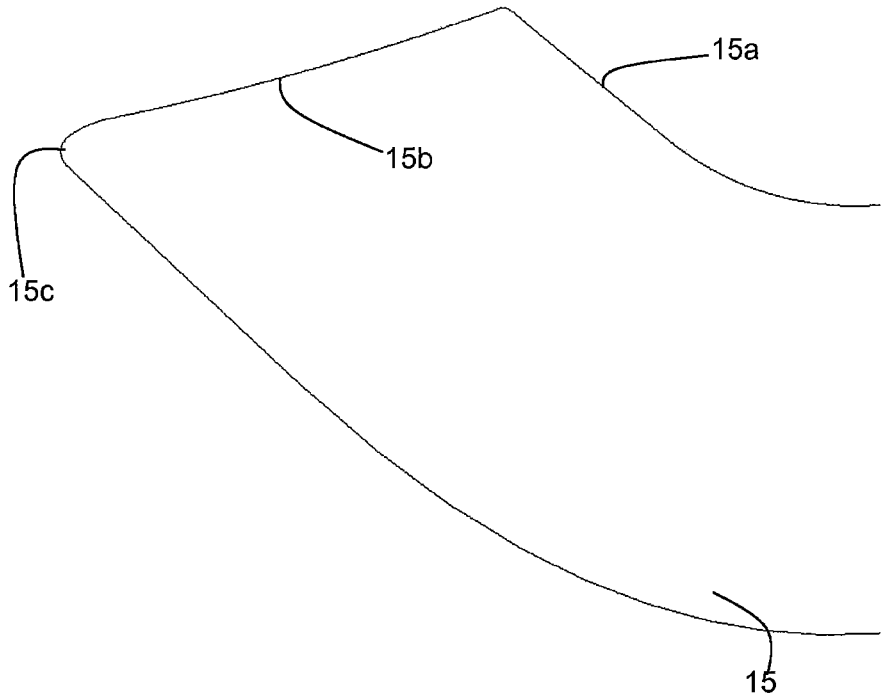
FIG. 3 represents an enlarged view of the exit pallet.

FIG. 1 depicts an escapement 1 according to the invention. This escapement 1 embodies the overall form of a Swiss anchor escapement, in which each pallet participates in providing an impulsion to the regulating member.

As generally known, the escapement comprises an escapement wheel 3, arranged to be driven by a power source, not depicted here. This power source may be a mainspring or an electric motor, for example, which is kinematically linked with the escapement wheel 3 by means of a going train (likewise not depicted).

The escapement wheel 3 is mounted in a pivotable manner on an arbor (not depicted), of which the theoretical axis is indicated by the reference sign 5. In the variant depicted here, the teeth of the escapement wheel 7 each include an upstream surface 7*a*, which interacts with the pallets when the escapement wheel 3 is blocked, and an impulsion surface. However, the invention is applicable to other forms of escapement wheel, for example to pointed teeth (English anchor escapement), or to less conventional forms.

The teeth 7 of the escapement wheel 3 interact in a known manner with an anchor 9, which pivots about a theoretical axis of rotation 11. In the variant depicted here, this theoretical axis 11 coincides with an arbor (not depicted), but an anchor of the "suspended" type as described in document CH708113, or of any other appropriate type, is equally possible. The line joining the axis of rotation 5 of the escapement wheel 3 and that of the anchor defines a center-to-center line 12.

The overall form of the depicted anchor 9 is traditional. In this respect, it includes a rod 9*a* extending from the axis of rotation 11 and terminating in a fork 9*c*, which interacts with a regulating member (not depicted) in a known manner in order to cause it to oscillate with a predetermined periodicity, which need not be described here in detail. Furthermore, a pair of arms 9*b* extend to either side of the axis of rotation 11 in directions substantially perpendicular to the rod 9*a*, and are terminated by pallets 13, 15. It goes without saying that other less common forms of anchor may also be utilized within the framework of the invention.

Each of these pallets 13, 15 is arranged to block and to release the escapement wheel periodically, the latter being blocked by one of the pallets 13, 15 and then re-blocked by the other, in sequence.

The pallet 13 depicted on the right in FIG. 1 is the entry pallet, situated upstream in the direction of rotation of the escapement wheel 3 indicated by the arrow, and the pallet 15, situated downstream, is the exit pallet.

In the variant depicted here, the pallets 13, 15 are integral with the anchor 9, although the invention is likewise applicable to pallets attached to the arms 9*b*. Each pallet 13, 15 includes, as generally known, a rest surface 13*a*, 15*a* respectively, and an impulsion surface 13*b*, 15*b* respectively. The rest surfaces 13*a*, 15*a*, serve to block the escapement wheel 3 during rest phases, and the impulsion surfaces 13*b*, 15*b* cooperate with the teeth 7 in order to transmit an impulsion to the anchor and thus to the regulating member during the impulsion phase. Each of these teeth 7 includes a rest beak 7*c*, which interacts with the rest surfaces 13*a*, 15*a* of the pallets 13, 15, as well as an oblique impulsion surface 7*b*. The rest beak 7*c*, which is present between the upstream surface 7*a* and the impulsion surface 7*b*, as well as this impulsion surface 7*b*, contribute to transmit an impulsion to the anchor 9.

In a typical escapement of the kind that has just been defined, the rest surfaces 13*a*, 15*a* are typically planes, of which the angle is selected in such a way that, during rest phases, the force F resulting from contact between the rest surface 13*a*, 15*a* and the tooth 7 comprises a component which tends to keep the pallet 13 or 15, as appropriate, engaged with the escapement wheel 3. This force F as a result generates a torque about the axis of rotation 11 of the anchor 9, which tends to cause the anchor to pivot in the anticlockwise direction (according to the orientation in FIG. 1) when the entry pallet 13 is engaged, and in the clockwise direction when the exit pallet 15 is engaged.

In a typical escapement, the impulsion surfaces of the pallets 13*b*, 15*b* are typically planes, which, during the impulsions, causes a reduction in the torque transmitted from the escapement wheel 3 to the anchor 9 during each impulsion phase. This variation in torque is inefficient and limits the performance of the escapement 1.

The invention, as a result, primarily concerns the form of the impulsion surfaces 13*b*, 15*b* of the pallets 13, 15, as well as that of the impulsion surface 7*b* of the teeth 7 of the escapement wheel 3. Since the active surfaces 13*a*, 13*b*, 15*a*, 15*b* of the pallets are not, or at least do not need to be, planar, the terminology of "surface" is utilized in place of the usual formulation "plane of . . . ".

Figure 4:
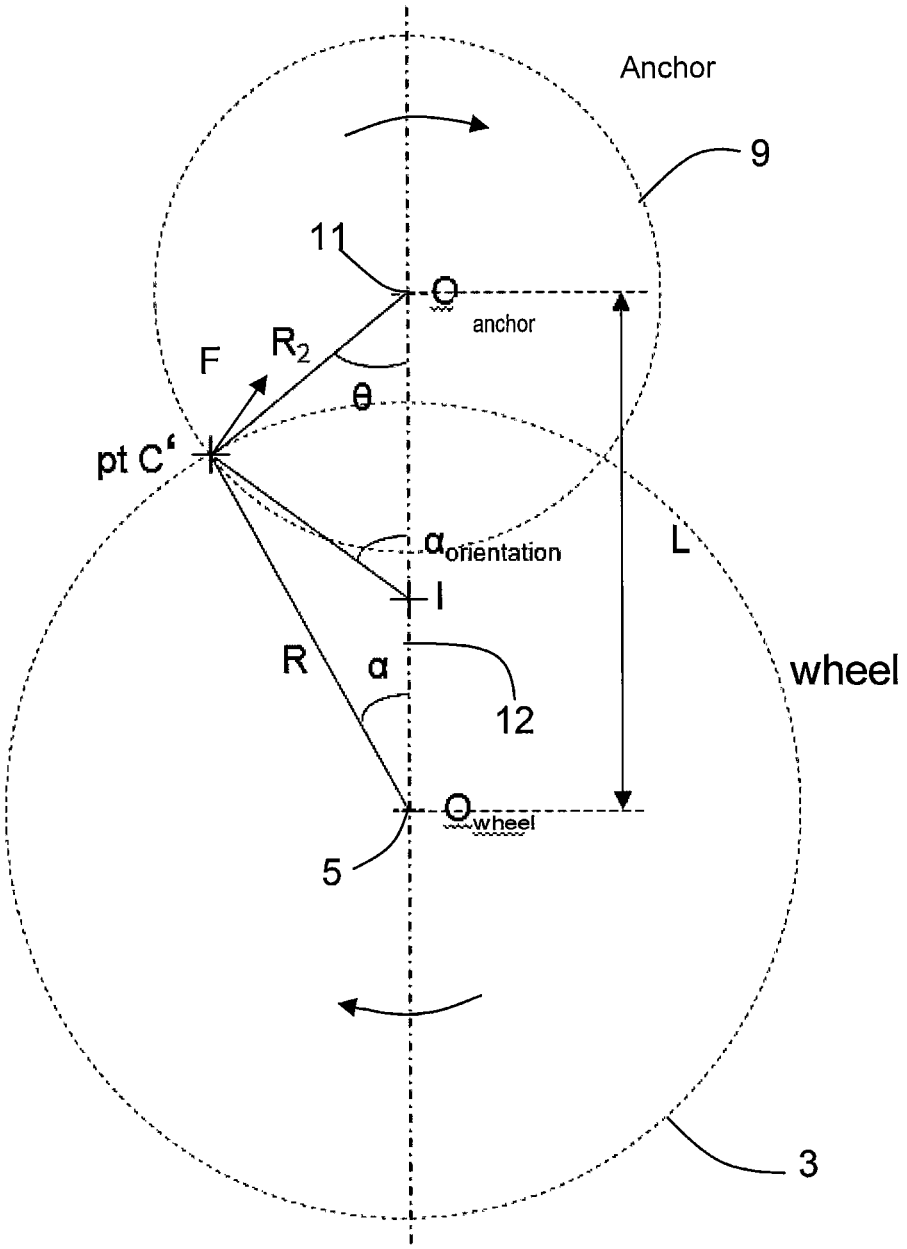
FIG. 4 represents a schematic modeling of the point of contact between the anchor and the escapement wheel.

FIG. 4 depicts a modeling schematic which may be utilized for calculating the form of the impulsion surfaces of the pallets. The geometrical relationship between the point of contact C' between the impulsion surface 13*b* of the entry pallet and a tooth 7 of the escapement wheel 3, the escapement wheel 3 and the center-to-center line 12 is depicted in the diagram which constitutes this figure.

In order for the force F that the escapement wheel 3 exerts on the entry pallet 13 to generate a torque which is constant throughout the impulsion phase, the angle $\alpha_{orientation}$ between the tangent of the impulsion surface 13*b* of the entry pallet and the center-to-center line 12 must observe the following relationship, obtained by resolving the forces, at each point during the impulsion phase:

$$\alpha_{orientation} = \alpha - COF + \tan^{-1}\left(\frac{C * R + \cos(\alpha - \theta) * R_2}{R_2 * \sin(\alpha - \theta)}\right)$$

where $$R_2 = \sqrt{R^2 * \sin^2(\alpha) + (-R * \cos(\alpha) + L)^2}$$

and where $$\theta = \tan^{-1}\left(R * \frac{\sin(\alpha)}{L - R * \cos(\alpha)}\right)$$

A tolerance of +/−10%, preferably +/−7%, more preferably +/−5% or even +/−3% or +/−2% can be added to the relationship which defines $\alpha_{orientation}$, in order for it to exhibit realistic manufacturing tolerances.

In these equations, all the angles are expressed in radians. $\alpha$ is the angle between a line joining said point of contact and the axis of rotation of said escapement wheel 3, and said center-to-center line 12, defined mathematically. This angle decreases, therefore, during the impulsion phase on the entry pallet 13, since the point of contact C' moves closer to the center-to-center line 12 when the escapement wheel 3 rotates. COF is the trigonometric tangent (in radians) of the coefficient of friction between the escapement wheel and said impulsion surface, that is to say tan(μ) according to the conventional notation; R is the distance between the axis of rotation of said escapement wheel and said point of contact, with a tolerance of +/−10%, preferably +/−7%, more preferably +/−5% or even +/−3% or +/−2%, in order for it to exhibit realistic manufacturing tolerances; C is the torque ratio between that of the anchor in relation to that of the escapement wheel, that is to say $C_{anchor}/C_{wheel}$; and L is the length of said center-to-center line 12.

It should be noted that, in view of the tolerance on the value of R as well as that on $\alpha_{orientation}$, the invention encompasses a family of possible curves. This is inevitable in view of the manufacturing tolerances, since it is very difficult to manufacture, in a reproducible manner, a curve which is mathematically perfect.

The same relationship is equally valid for the exit pallet 15, since the geometry is similar, the point of contact C' being situated, of course, on the other side of the center-to-center line 12.

Figure 5:
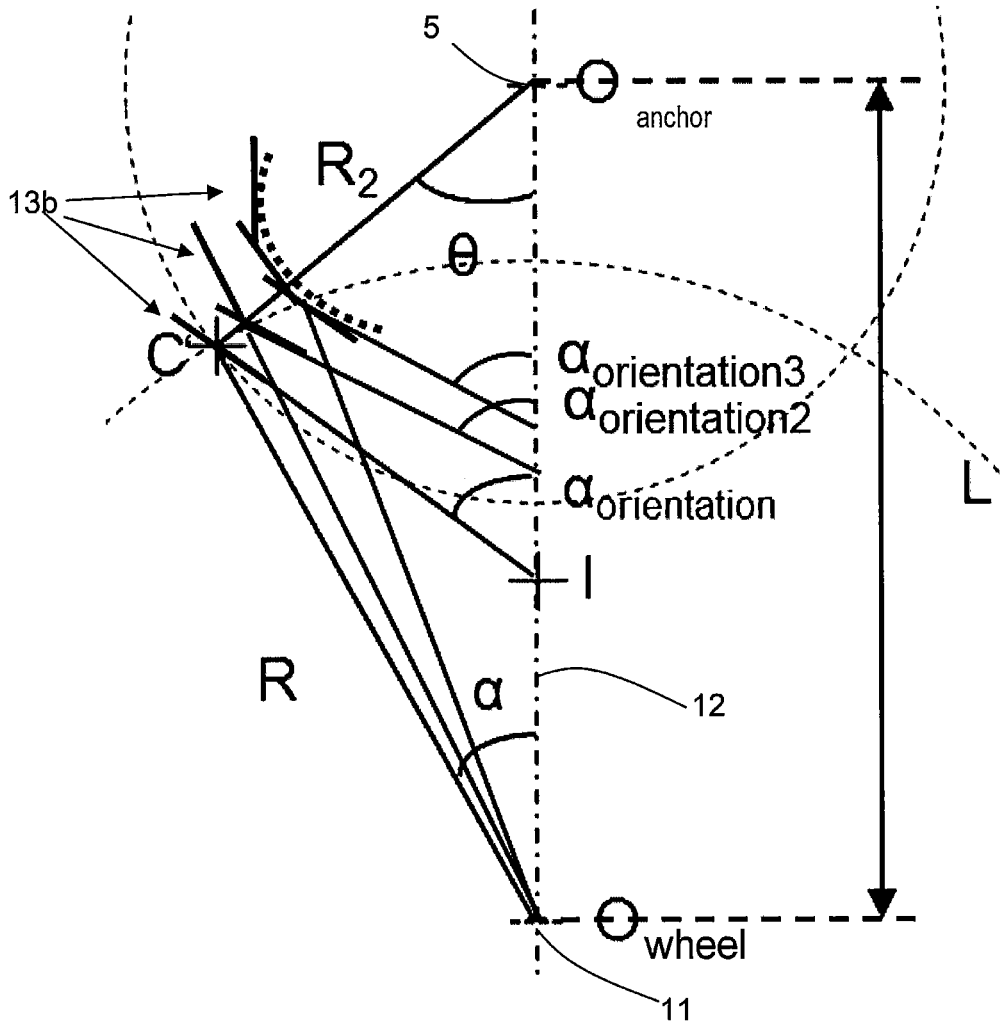
FIG. 5 represents an exaggerated schematic view of the development of the tangent of the profile of the impulsion surface of the entry pallet during the impulsion phase.

FIG. 5 depicts, in an exaggerated manner, the development of $\alpha_{orientation}$ of the impulsion surface 13*b* of the entry pallet 13 during its impulsion phase. It is clear that, when the escapement wheel 3 turns and the point of contact C' advances on an arc of a circle, the angle $\alpha_{orientation}$ increases when α decreases for the raisons explained above. FIG. 7 depicts this increase as a function of the angle α(t) of the point of contact C' in the course of time, and the values of the angle $\alpha_{orientation}$ thereby calculated at a plurality of points may be utilized to define tangents which may be combined in a smooth manner in order to define the form of the impulsion surface 13*b* of the entry pallet 13, for at least one part of its length. This part may extend, for example, for at least 20%, at least 40%, at least 50%, at least 60% or even at least 80% or 90% of the length of said impulsion surface 13*b*. According to these figures, it is clear that said impulsion surface 13 will be convex.

Figure 6:
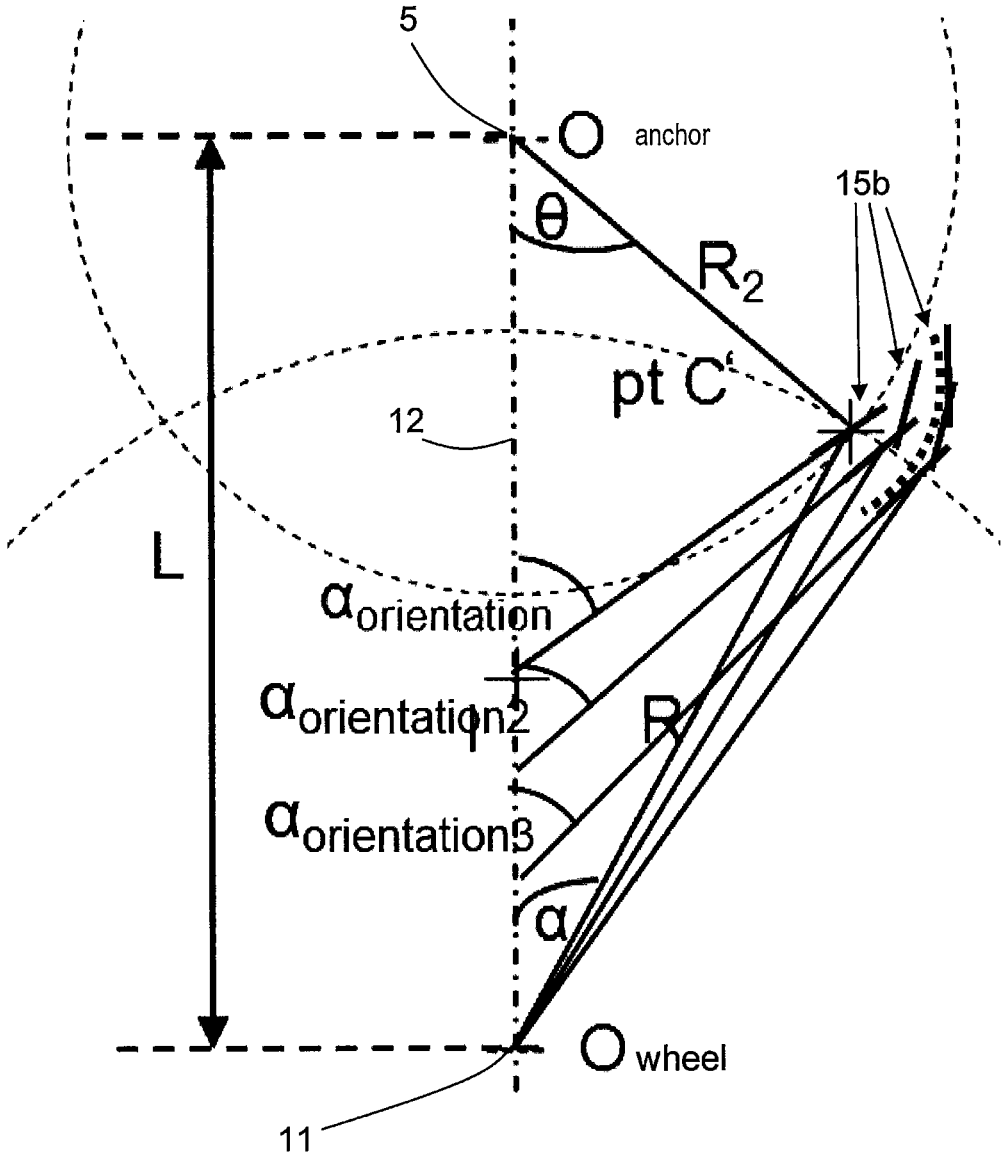
FIG. 6 represents an exaggerated schematic view of the development of the tangent of the profile of the impulsion surface of the exit pallet during the impulsion phase.

Similarly, FIG. 6 depicts, likewise in an exaggerated manner, the development of $\alpha_{orientation}$ of the impulsion surface 15*b* of the exit pallet 15 throughout its impulsion phase. It is clear, when the escapement wheel 3 turns and the point of contact C' advances on an arc of a circle, that the angle $\alpha_{orientation}$ decreases. FIG. 8 depicts this decrease as a function of the angle α of the point of contact C'; in fact, in the course of the movement, α moves away from the center-to-center line or α is strictly negative in the trigonometric sense, and therefore α(t) decreases in the course of the movement. Once again, the angles $\alpha_{orientation}$ thereby calculated may be utilized in order to define tangents which may be combined in order to define the form of the impulsion surface 15*b* of the exit pallet 15, for at least one part of its length. This part may extend, for example, for at least 20%, at least 40%, at least 50%, at least 60% or even at least 80% or 90% of the length of said impulsion surface 15*b*. In the case of the exit pallet 15, the angle α increases during the corresponding impulsion phase, since the point of contact C' moves away from the center-to-center line 12. According to these figures, it is clear that said impulsion surface 15 will be concave.

In the light of the foregoing, the forms of the impulsion planes 13*b*, 15*b* of the pallets may be determined for an escapement exhibiting a given geometry, also taking account of the form of the impulsion surfaces 7*b* of the teeth 7 of the escapement wheel 3, which determines the development of the position of the point of contact with the pallets 13, 15 during the impulsion phases.

Even if the forms of the pallets 13, 15 as determined above may be utilized in conjunction with an escapement wheel of known form, it is advantageous to adapt the form of the impulsion surfaces 7*b* in such a way that lifting-off of the pallet from the escapement wheel is avoided.

In essence, in the case of a conventional escapement, when the tooth 7 of the escapement wheel 3 performs the transition from the rest surface 13*a*, 15*a* of a pallet to its impulsion surface 13*b*, 15*b* (known as "impulsion on the pallet", since the tooth 7 interacts with the impulsion surface 13*b*, 15*b* of the pallet), an acceleration of the escapement wheel 3 and of the anchor 9 takes place. Furthermore, during the latter part of the impulsion phase, when the tooth interacts with the downstream beak 13*c*, 15*c* of the pallet 13, 15 (known as "impulsion on the tooth", since it is the downstream beak 13*c*, 15*c* of the pallet which interacts with the tooth 7), a second, even stronger acceleration is created. If these accelerations are too great, the pallet 13, 15 may separate from the escapement wheel 3, the effect of which is for the contact between these two elements to be interrupted.

The profile of the impulsion surface 7*b* of the teeth 7 of the escapement wheel can be determined, starting from the same model depicted in FIG. 4, which prevents such a lifting-off during the transition from the impulsion surface 7*b* to the downstream beak 7*d*.

According to the geometry of the contact between the escapement wheel 3 and the impulsion surface 13*b*, 15*b* of the one of the pallets, a torque ratio C between the torque of the anchor and the torque of the escapement wheel can be calculated as a function of the angle α as follows:

$$C(\alpha) = -\frac{R_2}{R} * \frac{\cos(\alpha_{orientation} - \theta + COF)}{\cos(\alpha_{orientation} - \alpha + COF)}$$

In this case, $\alpha_{orientation}$ represents the angle formed between the tangent of the impulsion surface 7*b* of the tooth 7 at the point of contact C' and the center-to-center line 12, the other variables being as described above. In the context of the profile of the impulsion surfaces 13*b*, 15*b* of the pallets 13, 15. In order to prevent lifting-off, the value C must be smaller than a predefined threshold value (see below).

During the impulsion phase on the tooth, that is to say when the downstream beak 13*c*, 15*c* is in contact with the impulsion surface 7*b* of a tooth 7 of the escapement wheel 3, $$C(\alpha) \leq \text{Seuil} * \alpha + C$$

where C is the torque ratio at this change of beak and Seuil is a value of a lifting-off threshold calculated by experimentation or by modeling, or even defined arbitrarily. In more practical terms, a threshold derivative of the speed ratio of the anchor 9 on the wheel 3 can be defined, for example, by modeling. The parameter Seuil is influenced to such an extent by the geometry of the escapement, although modelizations have indicated that a value not exceeding 0.01, preferably not exceeding 0.005, are generally applicable, or at any rate may serve as points of departure.

Consequently, $$Seuil * \alpha + C = -\frac{R_2}{R} * \frac{\cos(\alpha_{orientation} - \theta + COF)}{\cos(\alpha_{orientation} - \alpha + COF)}$$

and $$\alpha_{orientation} = \tan^{-1}\left(\frac{R * Seuil * \alpha * \cos(\alpha) + C * R * \cos(\alpha) + R * \cos(\alpha) - L}{R * \sin(\alpha) * (Seuil * \alpha + C - 1)}\right)$$

In this relationship, a tolerance of +/−10%, preferably +/−7%, more preferably +/−5% or even +/−3% or +/−2% can be added to the value of $\alpha_{orientation}$, in order to exhibit realistic manufacturing tolerances. It should be noted that, in view of the tolerance on the value of R as well as that on $\alpha_{orientation}$, the invention encompasses a family of possible curves. This is inevitable in view of the manufacturing tolerances, since it is very difficult to manufacture, in a reproducible manner, a curve that is mathematically perfect.

Figure 9:
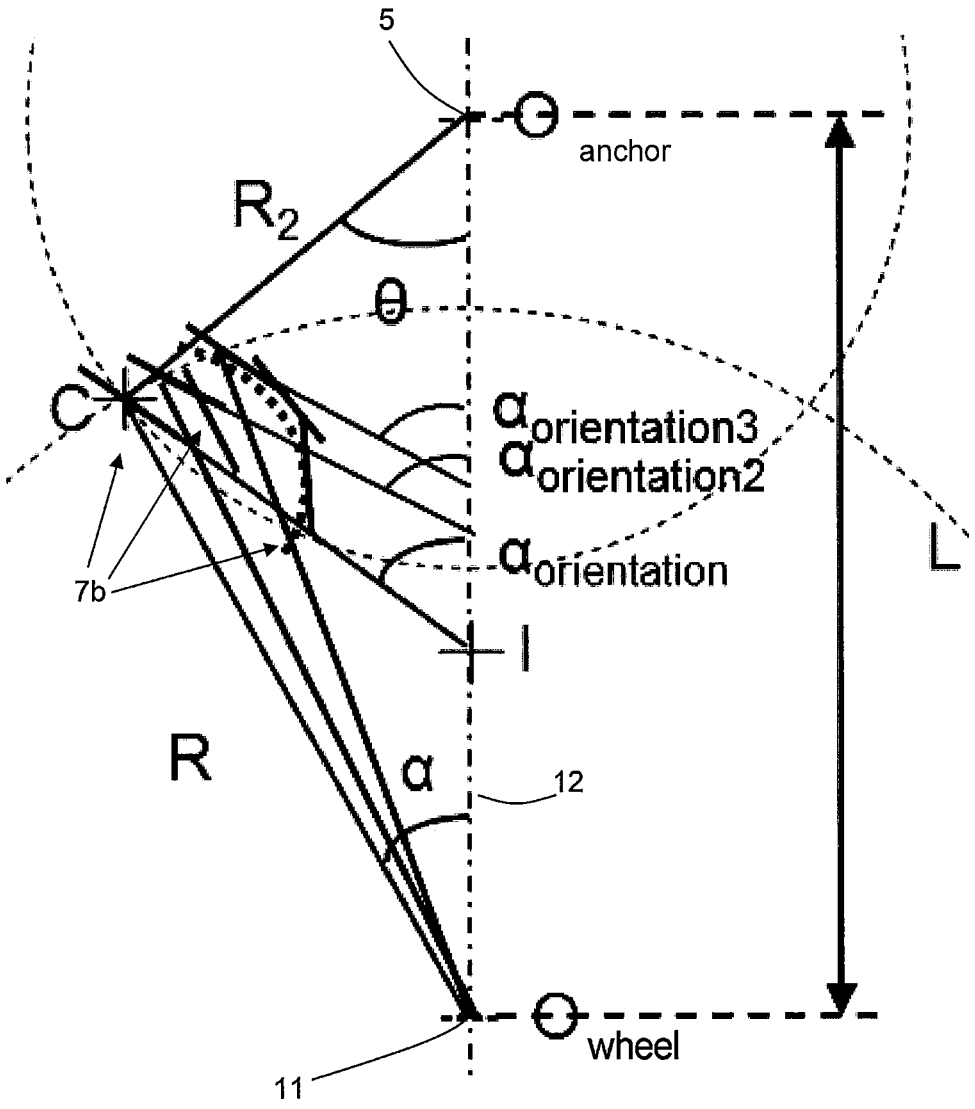
FIG. 9 represents an exaggerated schematic view of the development of the tangent of the profile of the impulsion surface of a tooth of the escapement wheel during the impulsion phase.
Figure 10:
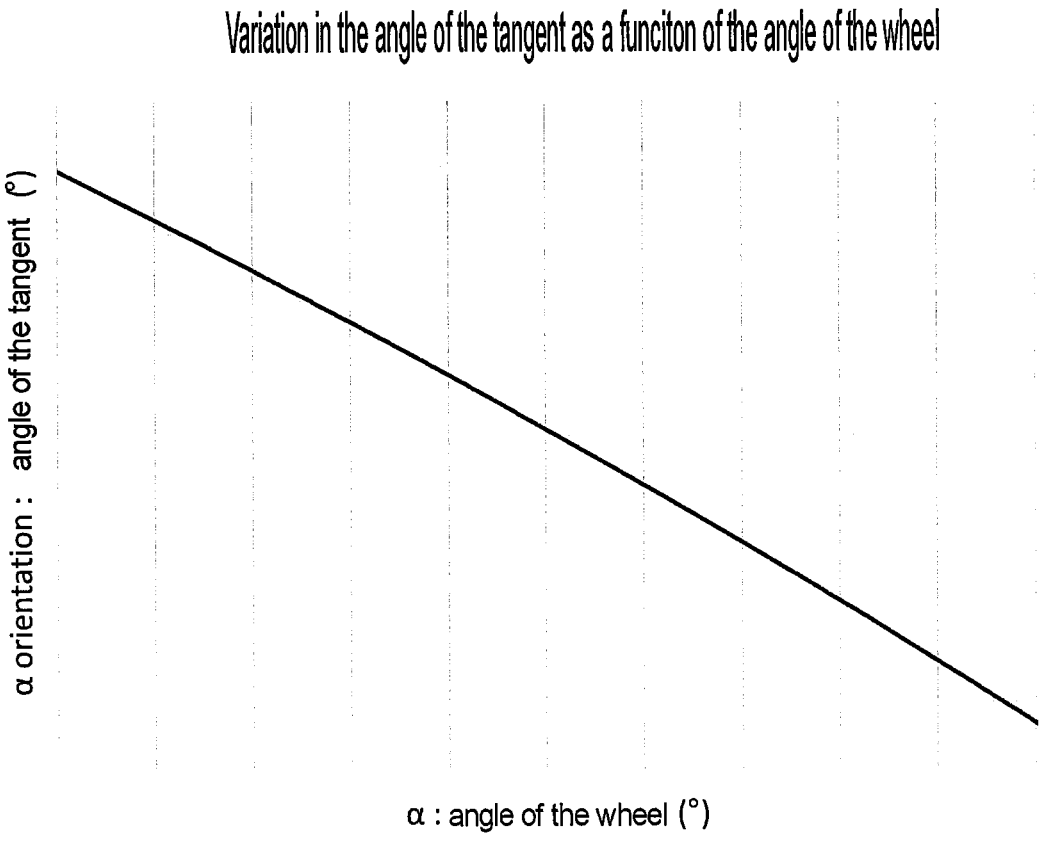
FIG. 10 represents a graph of the development of the tangent of the profile of the impulsion surface of a tooth of the escapement wheel during the impulsion phase.

As a result, when α increases during the impulsion phase, $\alpha_{orientation}$ increases likewise, in an approximately linear fashion. Thus, the profile of the impulsion surface 7*b* of the teeth 7 is convex, as depicted in exaggerated form in FIG. 9. The development of $\alpha_{orientation}$ as a function of the angle α is likewise depicted in FIG. 10.

Once again, as is the case for the pallets 13, 15, the angle $\alpha_{orientation}$ may be calculated at several points, in order to determine the profile of said impulsion surface 7*b* in the manner referred to above.

Figure 11:
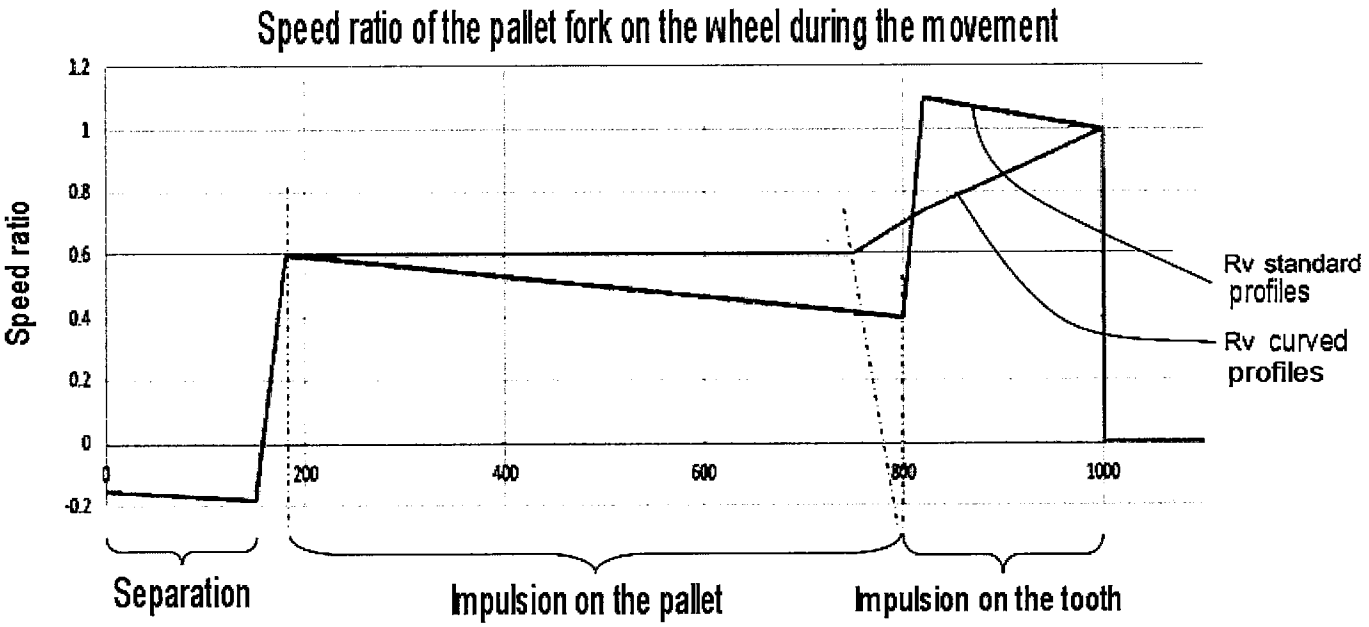
FIG. 11 represent a graph of the development of the speed ratio of the anchor on the escapement wheel in the course of the impulsion phase.

FIG. 11 is a normalized graph illustrating a comparison of the speed ratio of the anchor 9 on the escapement wheel 3 on an unlocking and an impulsion, for a conventional escapement ("Rv standard profiles") and an escapement according to the invention ("Rv curved profiles"). This graph depicts both the effect of the form of the impulsion surfaces 13*b*, 15*b*, which assures a transmission of constant torque during the impulsion phase on the impulsion surface 7*b* of a tooth 7, and the effect of the curved profile of the teeth 7 of the escapement wheel.

As far as concerns the transmission of constant torque, looking at the part of the graph indicated by "impulsion on the pallet", for the conventional escapement, the speed ratio "Rv standard profiles" decreases throughout this phase, for the reasons mentioned above. On the other hand, for the escapement according to the invention, the speed ratio "Rv curved profiles" remains constant, since the torque ratio remains constant. It is likewise clear from this graph that the integral of the function "Rv curved profiles" during the impulsion phase on the surface is greater than that of "Rv standard profiles", and that consequently more energy is supplied to the anchor during this phase of the impulsion. In fact, the above-mentioned value Seuil may be determined by considering the desired incline for the line "Rv curved profiles" during the impulsion on the tooth, which represents the first derivative of the angular speed ratio.

This graph also illustrates the effect of the curved profile of the impulsion surface 7*b* of the teeth 7 of the escapement wheel 3. Since this surface 7*b* is curved, the incline of the curve of the speed ratio presents a significantly smaller incline than that which is present in the conventional case "Rv standard profiles". A lifting-off may thus be avoided.

In the case in which the form of the impulsion planes 7*b* of the teeth 7 of the escapement wheel 3 is straight, the corresponding curve will follow that of the "Rv curved profiles" until the intersection with the vertical line has the normalized value 800, and will then be combined with that of the "Rv standard profiles" until the end of the impulsion phase.

Although this profile of the impulsion surfaces 7*b* of the teeth 7 of the escapement wheel 3 is depicted here in combination with the optimized forms of the pallets 13, 15, it may nevertheless be utilized with known pallets, for example pallets exhibiting standard planes.

Calculations have shown that the form of the impulsion surfaces 13*b*, 15*b* of the pallets 13, 15 increases the performance by about 2 to 3 points, and the form of the impulsion surface 7*b* of the teeth 7 of the escapement wheel increases it by about 2 to 3 points extra. The combination of the two optimizations consequently adds about 4 to 6 performance points to the escapement.

The anchor 9 and/or the escapement wheel 3 described above may, for example, be manufactured by micro-machining processes, such as LIGA, 3D printing, masking and engraving from a sheet of material, by stereolithography or similar. Appropriate materials may be selected, for example, from among the monocrystalline, polycrystalline or amorphous metals (such as steel, nickel-phosphorus, brass and similar), the non-metals such as silicon, its oxide, its nitride or its carbide, alumina in all its forms, diamond (including adamantine carbon), these non-metallic materials being monocrystalline or polycrystalline. All these materials may possibly be coated with another hard and/or anti-friction material, such as adamantine carbon or silicon oxide.

The utilization of these curved profiles brings about an improvement in the performance of the escapement 1 in the order of 5% if the profiles are adopted on the pallets 13, 15 and on the escapement wheel 3.

Although the invention is described above in conjunction with specific embodiments, additional variants are also conceivable without departing from the scope of the invention as defined by the claims.

The invention claimed is:

1. An escapement for a timepiece, comprising:

an escapement wheel mounted in a pivotable manner about a corresponding axis of rotation and intended to be driven by a power source, said escapement wheel including a plurality of teeth;

an anchor mounted in a pivotable manner about a corresponding axis of rotation, said anchor comprising an entry pallet and an exit pallet, each pallet comprising a rest surface arranged to block said escapement wheel, as well as an impulsion surface arranged to interact with said escapement wheel in order to transmit impulsions received from the latter to a regulating member arranged to produce oscillations, said anchor being arranged to release said escapement wheel periodically under the control of said regulating member, wherein at least one of said impulsion surfaces is configured in such a way that, on at least one part of said impulsion surface, and considered at each point of contact between the escapement wheel and said impulsion surface, the tangent of said impulsion surface intersects a center-to-center line between the escapement wheel and the anchor at an angle $\alpha_{orientation}$ which observes the relationship:

$$\alpha_{orientation} = \alpha - COF + \tan^{-1}\left(\frac{C * R + \cos(\alpha - \theta) * R_2}{R_2 * \sin(\alpha - \theta)}\right) +/-10\%$$

where $$R_2=\sqrt{R^2*\sin^2(\alpha)+(-R*\cos(\alpha)+L)^2}$$

and where $$\theta = \tan^{-1}\left(R*\frac{\sin(\alpha)}{L-R*\cos(\alpha)}\right)$$

in which all the angles are expressed in radians, and $\alpha_{orientation}$ &is the angle between said tangent with said center-to-center line;

$\alpha$ is the angle between a line joining said point of contact and the axis of rotation of said escapement wheel and said center-to-center line;

COF is the trigonometric tangent of the coefficient of friction between the escapement wheel and said impulsion surface;

R is the distance between the axis of rotation of said escapement wheel and said point of contact, +/−10%;

C is the torque ratio between that of the anchor and that of the escapement wheel;

L is the length of said center-to-center line.

2. The escapement as claimed in claim 1, in which the impulsion surface of the entry pallet is convex.

3. The escapement as claimed in claim 1, in which the impulsion surface of the exit pallet is concave.

4. The escapement as claimed claim 1, in which the escapement wheel includes teeth having convex impulsion surfaces.

5. An escapement for a timepiece, comprising:

an escapement wheel mounted in a pivotable manner about a corresponding axis of rotation and intended to be driven by a power source, said escapement wheel including a plurality of teeth;

an anchor mounted in a pivotable manner about a corresponding axis of rotation, said anchor comprising an entry pallet and an exit pallet, each pallet comprising a rest surface arranged to block said escapement wheel, as well as an impulsion surface arranged to interact with said escapement wheel in order to transmit impulsions received from the latter to a regulating member arranged to produce oscillations, said anchor being arranged to release said escapement wheel periodically under the control of said regulating member, wherein, on at least one part of an impulsion surface that each of said teeth includes, and considered at each point of contact between said impulsion surface and one of said pallets, the tangent of said impulsion surface intersects a center-to-center line between the escapement wheel and the anchor at an angle $\alpha_{orientation}$ which observes the relationship $$\alpha_{orientation} = \tan^{-1}\left(\frac{R*Seuil*\alpha*\cos(\alpha)+C*R*\cos(\alpha)+R*\cos(\alpha)-L}{R*\sin(\alpha)*(Seuil*\alpha+C-1)}\right)+/-10\%$$

in which $\alpha_{orientation}$ is the angle between said tangent and said center-to-center line;

$\alpha$ is the angle between a line joining said point of contact and the axis of rotation of said escapement wheel and said center-to-center line;

Seuil is value for a lifting-off threshold between the escapement wheel and the anchor;

R is the distance between the axis of rotation of said escapement wheel and said point of contact, +/−10%;

C is the torque ratio between that of the anchor and that of the escapement wheel;

L is the length of said center-to-center line.

6. The escapement as claimed in claim 5, in which the escapement wheel includes teeth having convex impulsion surfaces.

7. The escapement as claimed in claim 5, in which said value Seuil is a function of the first derivative of the speed ratio of the anchor on the escapement wheel at the time of the impulsion on the beak of said pallet.

8. An escapement for a timepiece, comprising:

an escapement wheel mounted in a pivotable manner about a corresponding axis of rotation and intended to be driven by a power source, said escapement wheel including a plurality of teeth;

an anchor mounted in a pivotable manner about a corresponding axis of rotation, said anchor comprising an entry pallet and an exit pallet, each pallet comprising a rest surface arranged to block said escapement wheel, as well as an impulsion surface arranged to interact with said escapement wheel in order to transmit impulsions received from the latter to a regulating member arranged to produce oscillations, said anchor being arranged to release said escapement wheel periodically under the control of said regulating member, wherein at least one of said impulsion surfaces is configured in such a way that, on at least one part of said impulsion surface, and considered at each point of contact between the escapement wheel and said impulsion surface, the tangent of said impulsion surface intersects a center-to-center line between the escapement wheel and the anchor at an angle $\alpha_{orientation}$ which observes the relationship:

$$\alpha_{orientation} = \alpha - COF + \tan^{-1}\left(\frac{C*R+\cos(\alpha-\theta)*R_2}{R_2*\sin(\alpha-\theta)}\right)+/-10\%$$

where $$R_2=\sqrt{R^2*\sin^2(\alpha)+(-R*\cos(\alpha)+L)^2}$$

and where $$\theta = \tan^{-1}\left(R*\frac{\sin(\alpha)}{L-R*\cos(\alpha)}\right)$$

in which all the angles are expressed in radians, and $\alpha_{orientation}$ is the angle between said tangent with said center-to-center line;

$\alpha$ is the angle between a line joining said point of contact and the axis of rotation of said escapement wheel and said center-to-center line;

COF is the trigonometric tangent of the coefficient of friction between the escapement wheel and said impulsion surface;

R is the distance between the axis of rotation of said escapement wheel and said point of contact, +/−10%;

C is the torque ratio between that of the anchor and that of the escapement wheel;

L is the length of said center-to-center line;

and wherein, on at least one part of an impulsion surface that each of said teeth includes, and considered at each point of contact between said impulsion surface and one of said pallets, the tangent of said impulsion surface intersects a center-to-center line between the escapement wheel and the anchor at an angle $\alpha_{orientation}$ which observes the relationship $$\alpha_{orientation} = \tan^{-1}\left(\frac{R * Seuil * \alpha * \cos(\alpha) + C * R * \cos(\alpha) + R * \cos(\alpha) - L}{R * \sin(\alpha) * (Seuil * \alpha + C - 1)}\right)_{+/-10\%}$$

in which $\alpha_{orientation}$ is the angle between said tangent and said center-to-center line;

$\alpha$ is the angle between a line joining said point of contact and the axis of rotation of said escapement wheel and said center-to-center line;

Seuil is value for a lifting-off threshold between the escapement wheel and the anchor;

R is the distance between the axis of rotation of said escapement wheel and said point of contact, +/−10%;

C is the torque ratio between that of the anchor and that of the escapement wheel;

L is the length of said center-to-center line.

9. A watch movement comprising an escapement as claimed in claim 1.

10. A timepiece comprising a movement according to claim 9.

11. A watch movement comprising an escapement as claimed in claim 5.

12. A timepiece comprising a movement according to claim 10.

13. A watch movement comprising an escapement as claimed in claim 8.

14. A timepiece comprising a movement according to claim 13.

* * * * *